US009440829B2

(12) United States Patent
Sadiq

(10) Patent No.: US 9,440,829 B2
(45) Date of Patent: Sep. 13, 2016

(54) ADJUSTING DAMPING PROPERTIES OF AN IN-LINE PASSIVE HEAVE COMPENSATOR

(71) Applicant: MHD Offshore Group SDN. BHD, Kapar, Klang, Selangor Darul Ehsan (MY)

(72) Inventor: Muhammad Sadiq, Houston, TX (US)

(73) Assignee: MHD Offshore Group SDN. BHD., Kapar (MY)

( * ) Notice: Subject to any disclaimer, the term of this patent is extended or adjusted under 35 U.S.C. 154(b) by 0 days.

(21) Appl. No.: 14/537,705

(22) Filed: Nov. 10, 2014

(65) Prior Publication Data

US 2015/0285037 A1 Oct. 8, 2015

(30) Foreign Application Priority Data

Apr. 8, 2014 (MY) ..... PI-2014700859

(51) Int. Cl.

| | |
|---|---|
| ***E21B 19/00*** | (2006.01) |
| ***B66F 11/00*** | (2006.01) |
| ***B66C 13/04*** | (2006.01) |
| ***B66C 23/52*** | (2006.01) |

(52) U.S. Cl.

CPC ..... *B66F 11/00* (2013.01); *B66C 13/04* (2013.01); *B66C 23/52* (2013.01)

(58) Field of Classification Search

CPC ..... E21B 19/006; E21B 41/0007
USPC ..... 166/355
See application file for complete search history.

(56) References Cited

U.S. PATENT DOCUMENTS 4,121,806 A * 10/1978 Iato et al. ..... 166/355
4,185,652 A * 1/1980 Zintz et al. ..... 137/78.2
5,209,302 A 5/1993 Robichaux et al.
5,846,028 A * 12/1998 Thory ..... 405/195.1
7,108,457 B1 * 9/2006 Brown et al. ..... 405/216
7,819,195 B2 * 10/2010 Ellis ..... 166/355

(Continued)

FOREIGN PATENT DOCUMENTS

WO WO2014122526 A2 8/2014

OTHER PUBLICATIONS

Johansen, "Cranemaster products," Cranemaster, Accessed May 23, 2014, 4 pages, http://cranemaster.no/Products/Products.html#ACS.

(Continued)

*Primary Examiner* — Amber Anderson
*Assistant Examiner* — Aaron Lembo
(74) *Attorney, Agent, or Firm* — Fish & Richardson P.C.

(57) ABSTRACT

In some aspects, an in-line passive heave compensator system includes a damper actuator, a fluid vessel, and a hydraulic manifold. The damper actuator extends and retracts in response to an external dynamic load, and the fluid vessel transfers hydraulic fluid between itself and the damper actuator (e.g., back and forth) as the damper actuator extends and retracts. The hydraulic manifold provides the channel of fluid transfer between the damper actuator and the fluid vessel. The hydraulic manifold includes an extension flow control device in an extension fluid path between the damper actuator and the fluid vessel. The extension fluid path receives fluid flow only during extension of the damper actuator. The hydraulic manifold includes a retraction flow control device in a retraction flow path between the damper actuator and the fluid vessel. The retraction flow path receives fluid flow only during the retraction of the damper actuator.

16 Claims, 7 Drawing Sheets

(56) References Cited

U.S. PATENT DOCUMENTS

| | | | | |
|---|---|---|---|---|
| 7,934,561 | B2 | 5/2011 | Ormond | |
| 8,251,148 | B2 | 8/2012 | Von Der Ohe | |
| 8,727,018 | B1 * | 5/2014 | Mcculloch | 166/375 |
| 2006/0042534 | A1 * | 3/2006 | Pollack et al. | 114/258 |
| 2007/0089884 | A1 * | 4/2007 | Patton | 166/355 |
| 2008/0060568 | A1 * | 3/2008 | Pollack et al. | 114/268 |
| 2008/0271896 | A1 * | 11/2008 | Inderberg et al. | 166/355 |
| 2011/0187065 | A1 * | 8/2011 | Van Der Knaap et al. | 280/5.507 |
| 2014/0014015 | A1 | 1/2014 | Roodenburg et al. | |
| 2014/0255219 | A1 * | 9/2014 | Lucas | 417/282 |
| 2014/0308105 | A1 * | 10/2014 | Soertveit et al. | 414/592 |

OTHER PUBLICATIONS

Martinsen, "Safelink Hercules X-1500 25/35 Crane Shock Absorber," SafeLink, Data Sheet, Feb. 13, 2014, 6 pages.

Karimi, "DCPHC 100-12000 Depth Compensated Passive Heave Compensator Technical Datasheet," Revision B, SafeLink, Sep. 15, 2012, 11 pages.

* cited by examiner

ADJUSTING DAMPING PROPERTIES OF AN IN-LINE PASSIVE HEAVE COMPENSATOR

CROSS-REFERENCE TO RELATED APPLICATIONS

This application claims priority to Malaysia Patent Application Serial No. PI-2014700859, filed on Apr. 8, 2014, entitled "Apparatus to Adjust Bi-Directional Hydraulic Damping Properties for Offshore In-Line Passive Heave Compensators," the entire contents of which is hereby incorporated by reference.

BACKGROUND

The following description relates to adjusting bi-directional damping properties of an in-line passive heave compensator, for example, in an offshore load-handling environment.

During the course of offshore load handling operations by in-line crane-mounted passive heave compensators, requirements for hydraulic damping properties vary for both extend and retract action of the compensator and are based upon the significant wave height. Also, the hydraulic damping properties are typically tailored for different operational circumstances. Therefore, a single or bi-directional fixed hydraulic damping property for extend and retract action of the compensator does not enable optimum efficiency for more than one significant wave height. Installing fixed-area orifices to cause a pressure drop between up-stream and down-stream fluid flows for the extend or retract direction of the compensator to control hydraulic damping will typically not provide the optimum efficiency for a specific range of wave height, for example, where the peak-to-peak wave amplitude difference is large enough.

In-line passive heave compensators are typically transported on pallets or frames. The compensator is separated from the transport frame to prepare the compensator for a working environment. The compensator is typically prepared for operation at one or more separate stations that may include hydraulic fluid storage; nitrogen gas storage; a hydraulic system or pumps to fill and drain the compensator of hydraulic fluid or execute functional and pressure testing of the units; and a nitrogen gas system to charge and discharge gas pressure within the compensator units.

SUMMARY

In a general aspect, an in-line passive heave compensator includes extension and retraction damping properties that are independently adjustable.

In some aspects, an in-line passive heave compensator system includes a damper actuator, a gas over fluid pressure vessel(s), and a hydraulic manifold. The damper actuator extends and retracts in response to an external dynamic load, pressurized fluid flows between gas over fluid pressure vessel(s) and damper actuator as it extends and retracts. The hydraulic manifold provides the flow path for pressurized fluid to flow between the damper actuator and the gas over fluid pressure vessel(s). The hydraulic manifold includes an extension flow-control device in an extension flow path between the damper actuator and the gas over fluid pressure vessel(s). The extension flow path receives flow only during extension of the damper actuator. The hydraulic manifold includes a retraction flow-control device in a retraction flow path between the damper actuator and the gas over fluid pressure vessel(s). The refraction flow path receives flow only during retraction of the damper actuator.

In some implementations, the extension flow-control device is adjustable to be more or less restrictive to flow through the extension flow path. In some implementations, the retraction flow-control device is adjustable to be more or less restrictive to flow through the retraction flow path.

The details of one or more implementations are set forth in the accompanying drawings and the description below. Other features, objects, and advantages will be apparent from the description and drawings, and from the claims.

DESCRIPTION OF DRAWINGS

FIG. 2 is a perspective view;

FIG. 3 is a cross-sectional top view; and FIG. 4 is a cross-sectional side view.

DETAILED DESCRIPTION

The present disclosure relates to an in-line passive heave compensator with a hydraulic manifold having integrated flow-control devices attached to the rod side of a hydraulic actuator and gas over fluid pressure vessel(s). The hydraulic manifold with integrated flow-control devices allows adjustable hydraulic damping in both extend and retract action of the damper actuator with respect to significant wave height by varying the areas of fluid flow using individual throttle valves within the integrated flow-control devices for extend and retract action of the compensator. In some instances, the hydraulic damping properties for both the extend and retract movements can be changed by adjusting the flow areas using the integrated flow-control device attached to the hydraulic manifold. In some instances, this allows for changing hydraulic damping properties without dismantling the unit. In some implementations, the integrated flow-control device can be online adjusted in real time, without any dismantling and depressurizing of units so the hydraulic damping corresponds to the current wave height for both extend and retract actions. This can provide high efficiencies in a full range of wave heights.

Figure 1A:
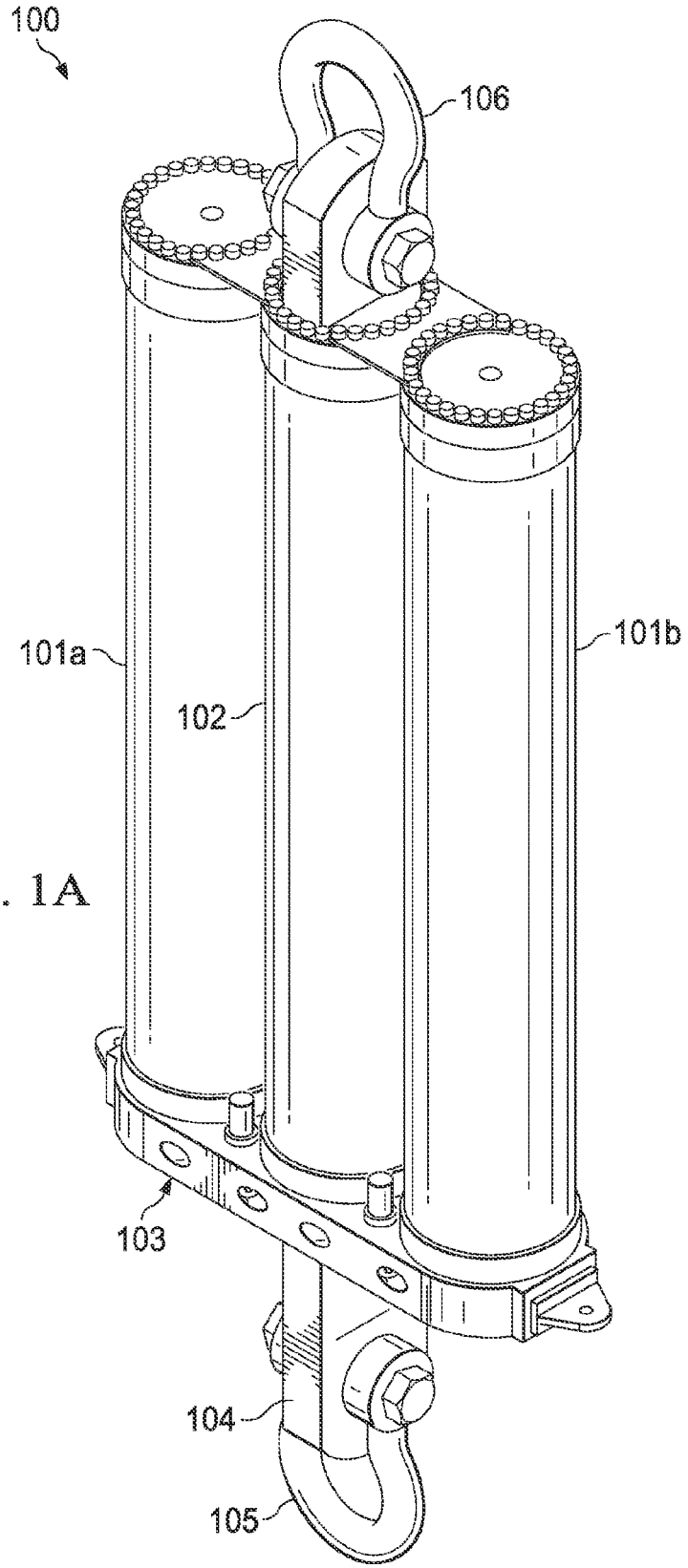
FIG. 1A is a perspective view of an example in-line passive heave compensator unit.
Figure 1B:
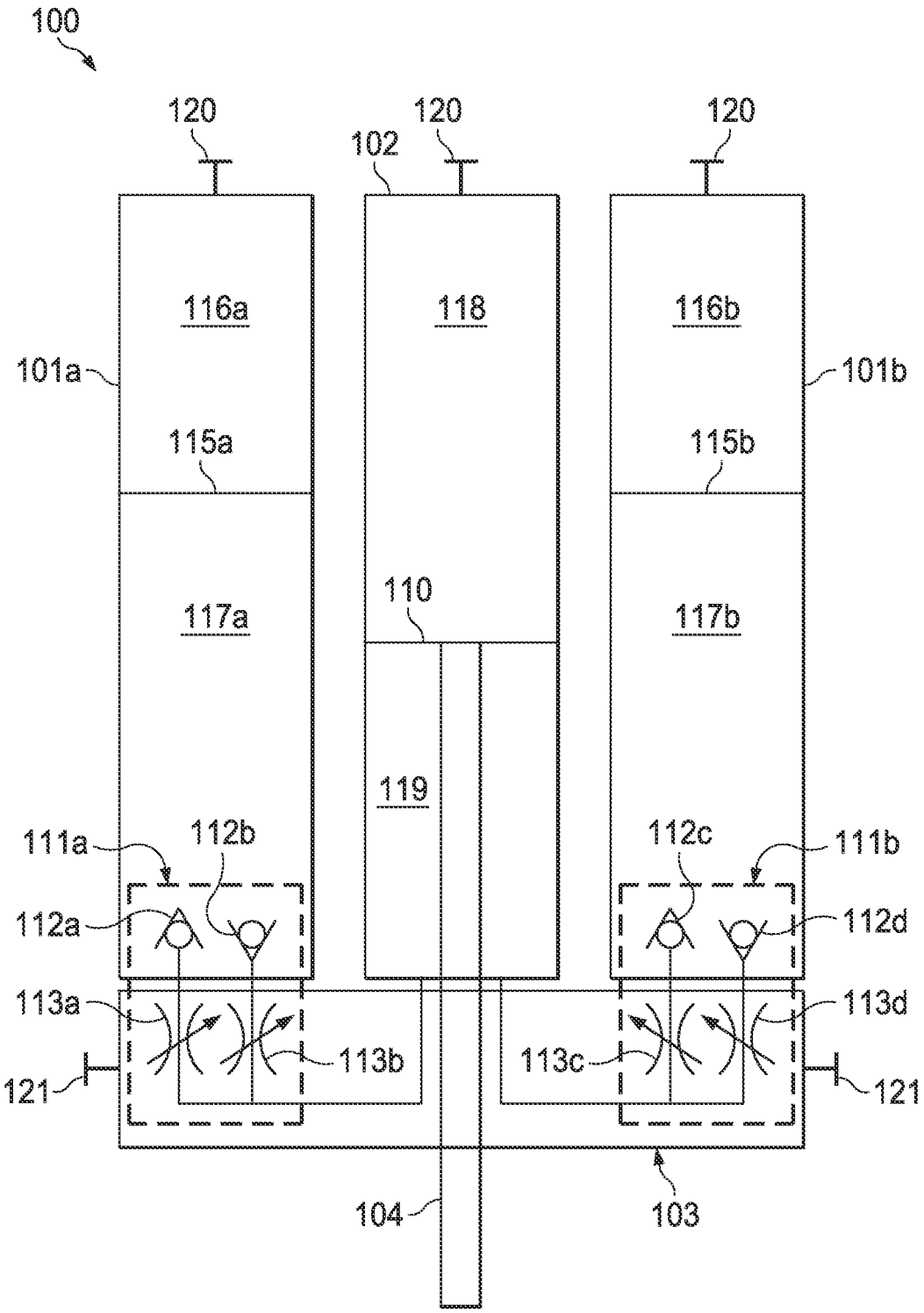
FIG. 1B is a schematic diagram of the example in-line passive heave compensator unit 100 shown in FIG. 1A.

FIG. 1A is a perspective exterior view of an example in-line passive heave compensator unit 100, and FIG. 1B is a schematic diagram of the internals of the example in-line passive heave compensator unit 100 shown in FIG. 1A. The heave compensator unit 100 includes a hydraulic manifold 103 attached to the rod side of damper actuator 102 and gas over fluid pressure vessels 101*a*, 101*b*. The hydraulic manifold 103 with integrated flow-control devices allows adjustable hydraulic damping in both extend and retract action of the damper actuator 102 with respect to significant wave height by varying the areas of fluid flow using individual throttle valves within the flow control devices for extend and retract action of the compensator.

Figure 2:
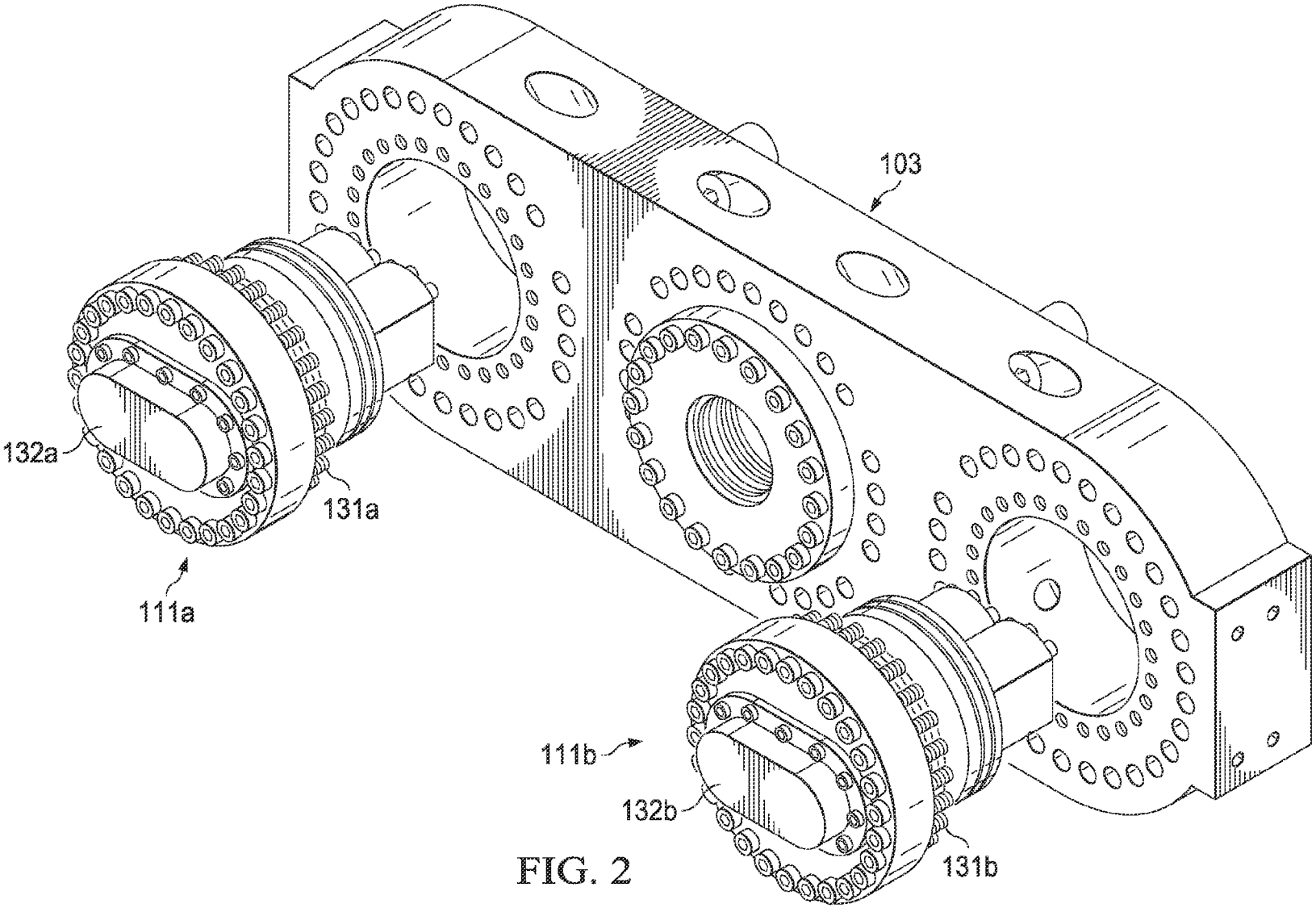
FIGS. 2, 3, and 4 show the hydraulic manifold 103 of the example in-line passive heave compensator unit 100 shown in FIG. 1A.
Figure 3:
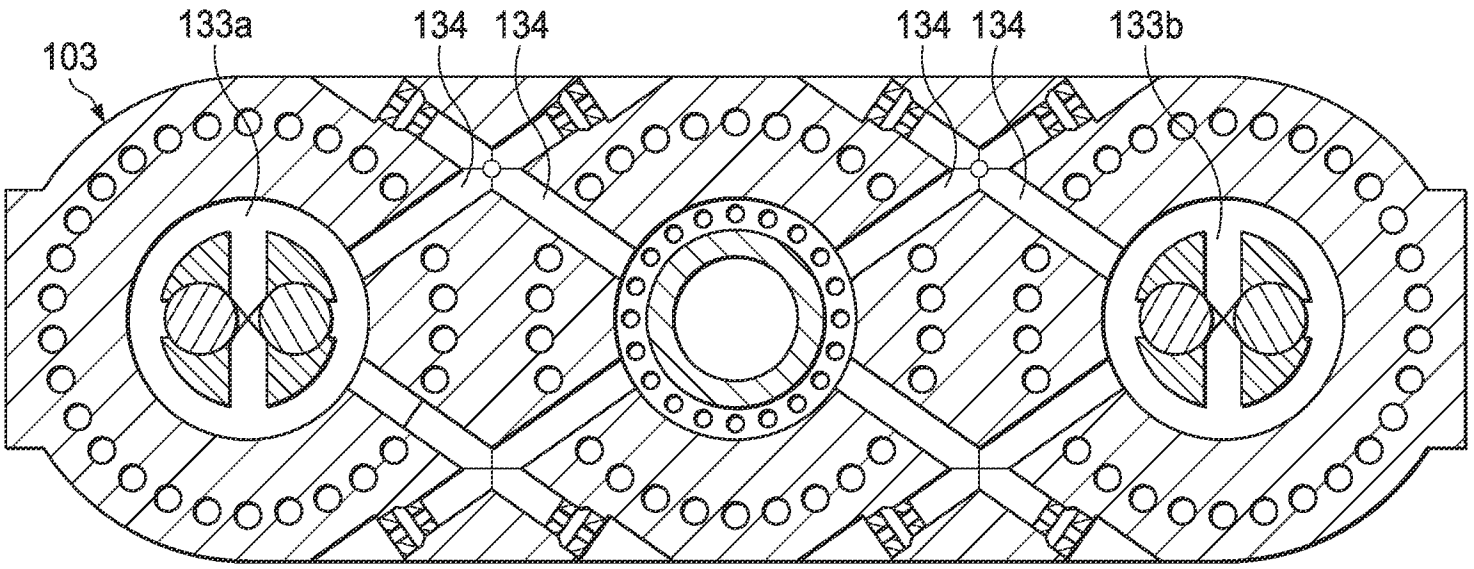
Figure 4:
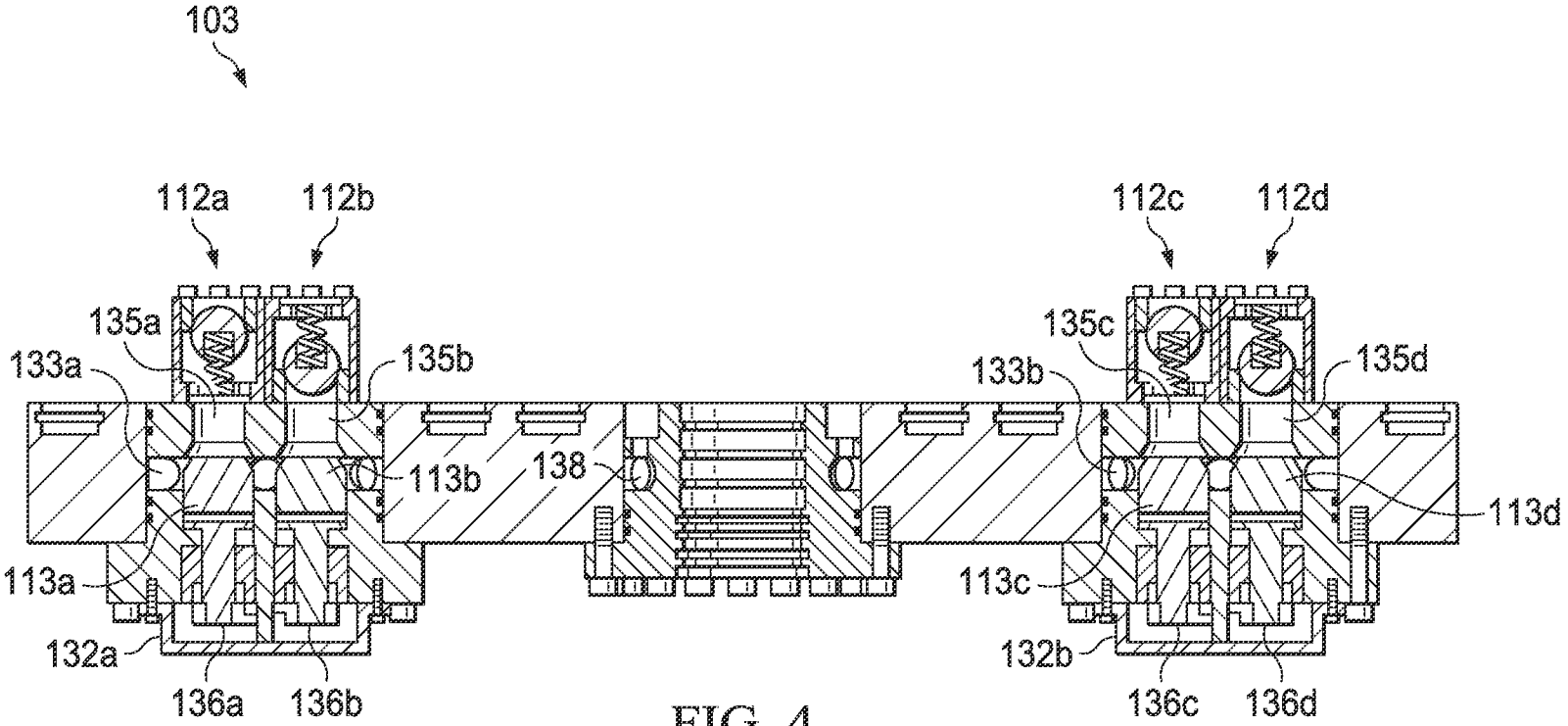
Figure 5:
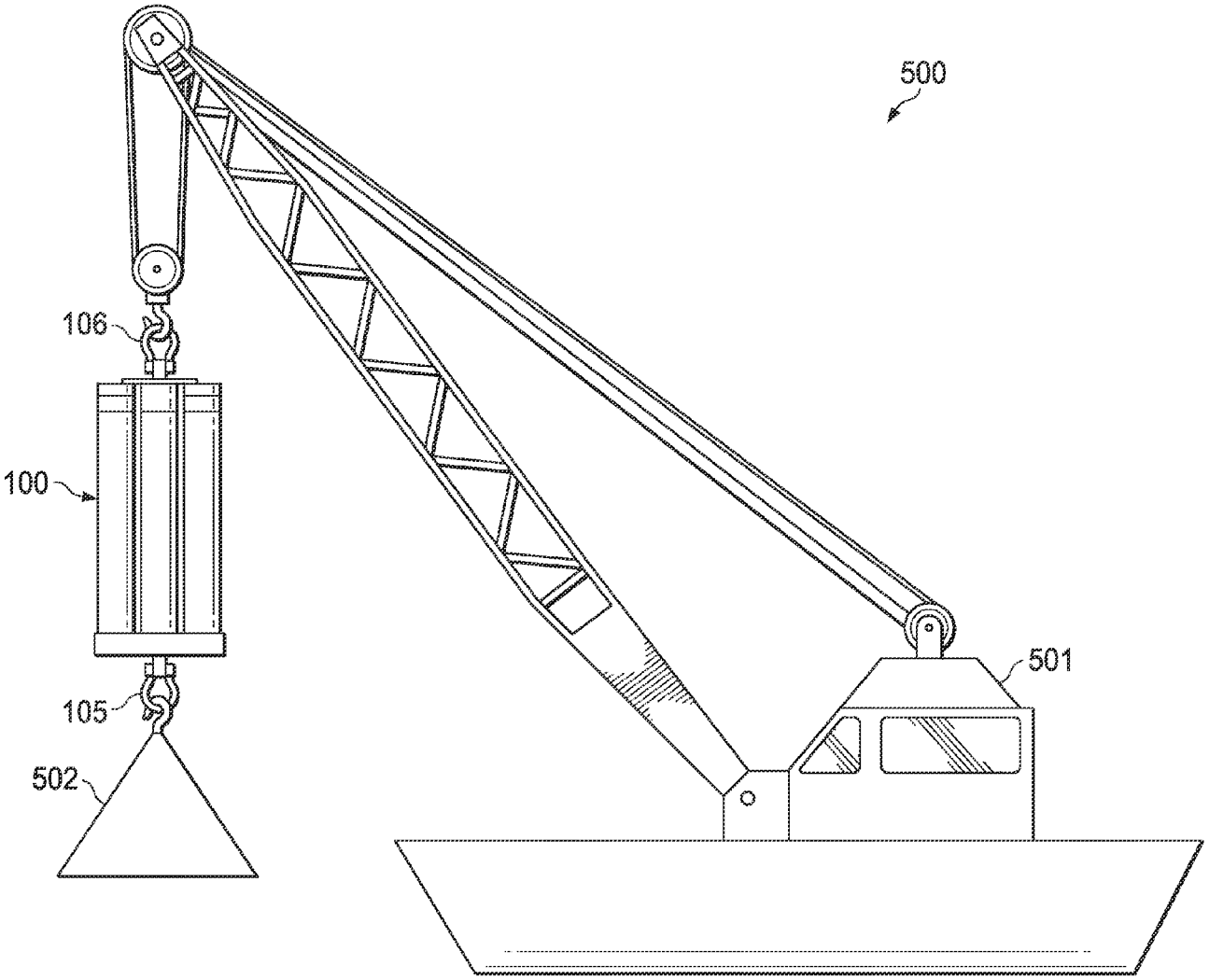
FIG. 5 is a schematic diagram of an example in-line passive heave compensator unit mounted between a crane hook and a payload.

FIGS. 2, 3, and 4 show the hydraulic manifold 103 of the example in-line passive heave compensator unit 100 shown in FIG. 1A. FIG. 2 is a perspective view showing the integrated flow-control devices 111*a*, 111*b* apart from the main body of the hydraulic manifold 103. FIGS. 3 and 4 are cross-sectional top and side views, respectively, where the integrated flow-control devices 111*a*, 111*b* are assembled to the main body of the hydraulic manifold 103. FIG. 5 is a schematic diagram showing the in-line passive heave compensator unit 100 mounted between a crane hook and a payload, for operating in an offshore loading system 500.

The in-line passive heave compensator gas over fluid pressure vessels 101*a*, 101*b* and the damper actuator 102 are installed on a common hydraulic manifold 103 using threaded connections 131*a*, 131*b*. The three elongate, tubular vessels (101*a*, 101*b*, 102) are connected to the hydraulic manifold 103 on the rod side of the damper actuator 102, as shown in FIG. 1A.

A rod 104 carried in the damper actuator 102 and attached to piston 110 moves in and out of the damper actuator 102 which provides retract and extend actions to the heave compensator unit 100. The heave compensator unit 100 as shown in FIG. 1 can be mounted in-line between a crane hook and a payload as shown in FIG. 5. An eye and shackle 105 coupled on an end of the rod 104 at the rod end of the heave compensator unit 100 can be connected to the payload 502, and an eye and shackle 106 at the opposite end of the heave compensator unit 100 can be connected to the crane 501, as shown in FIG. 5.

In the example shown, a hydraulic fluid chamber 119 in the damper actuator 102 and hydraulic fluid chambers 117*a*, 117*b* in the gas over fluid pressure vessels 101*a*, 101*b* contain hydraulic fluid. The volume of hydraulic fluid in the heave compensator unit 100 can be adjusted through the fluid ports 121 on the hydraulic manifold 103. In the example shown, a gas chamber 118 in the damper actuator 102 and gas chambers 116*a*, 116*b* in the gas over fluid pressure vessels 101*a*, 101*b* contain nitrogen gas. The pressure of the nitrogen gas in the gas chambers 118, 116*a*, 116*b* can be adjusted through the respective nitrogen ports 120. The hydraulic fluid chamber 119 is separated from the gas chamber 118 by a piston 110, affixed to the end of the rod 104 and sealed to the inner walls of the damper actuator 102. The hydraulic fluid chambers 117*a*, 117*b* are separated from their respective gas chambers 116*a*, 116*b* by free floating pistons 115*a*, 115*b*, sealed to the inner walls of their respective vessels 101*a*, 101*b*.

In some instances, the damper actuator 102 is filled with hydraulic fluid (e.g., oil), and gas over fluid pressure vessels 101*a*, 101*b* are charged with nitrogen gas. Other gasses and hydraulic fluids can be used. In operation, the hydraulic oil under nitrogen charged pressure flows back and forth between the damper actuator 102 and the two gas over fluid pressure vessels 101*a*, 101*b* as a result of the reaction of ocean heave motion. The flow path for this flow is through the hydraulic manifold 103, which includes fluid porting between the damper actuator 102 and the two gas over fluid pressure vessels 101*a*, 101*b*. Adjustable bi-directional hydraulic damping is achieved via the two integrated flow-control devices 111*a*, 111*b*.

As the heave motion shifts from trough to crest the damper actuator 102 starts to extend in similar proportion; therefore, fluid inside damper actuator 102 will be displaced by the sweeping piston 110 towards the rod end of the damper actuator to flow from within it to the two gas over fluid pressure vessels 101*a*, 101*b* through hydraulic porting 134 in the hydraulic manifold 103. The hydraulic porting 134 and the annular flow-control channels 133*a*, 133*b* in the integrated flow-control devices 111*a*, 111*b* provide fluid paths from the damper actuator 102 to the gas over fluid pressure vessels 101*a*, 101*b*. After the fluid flows through the flow-control channels 133*a*, 133*b*, pressure regulation takes place according to the setting of the flow-control extend throttle valves 113*b*, 113*d*. This regulation is controlled by the position of the flow-control extend throttle valves 113*b*, 113*d*, which can be adjusted, for example, depending on the characteristics of significant wave height (e.g., a certain value or a range of values of the significant wave height). In certain instances, the throttle valves 113*b*, 113*d* are multi-setting (i.e., more than just open or closed settings) or continuously variable flow metering valves. The flow-control extend throttle valves 113*b*, 113*d* create a venturi effect on the flow of hydraulic fluid through the hydraulic manifold 103.

When the damper actuator 102 extends, the nitrogen gas in the gas chamber 118 expands as the rod 104 pulls the piston 110 toward the hydraulic manifold 103, which forces hydraulic fluid from the hydraulic fluid chamber 119 into the hydraulic manifold 103. The nitrogen in the gas chamber 118 is typically at very low or near atmospheric pressure, so that it does not substantively resist or contribute movement of the piston 110. The nitrogen gas in the gas chamber 118 can maintain a small amount of positive pressure on the piston 100 seals, without providing a gas spring for the functioning of the heave compensator 100. In the hydraulic manifold 103, the hydraulic fluid flows through the annular flow path 138, through the hydraulic porting 134, through the flow-control channels 133*a*, 133*b*, through an opening defined by the position of the flow-control extend throttle valves 113*b*, 113*d*, into the flow-control extend direction ports 135*b*, 135*d*, through the actuator extend valves 112*b*, 112*d*, and into the gas over fluid pressure vessels 101*a*, 101*b*. The hydraulic fluid entering the hydraulic fluid chambers 117*a*, 117*b* of the gas over fluid pressure vessels 101*a*, 101*b* forces the pistons 115*a*, 115*b* away from the hydraulic manifold 103, which compresses the volume of the gas chambers 116*a*, 116*b*. The pressure of the nitrogen in chambers 116*a*, 116*b* is high enough that the nitrogen operates as a gas spring, applying force via the pistons 115*a*, 115*b* to the hydraulic fluid in fluid chambers 117*a*, 117*b* to cause the hydraulic fluid to flow out of the fluid chambers 117*a*, 117*b*. In some instances, the pressure is high enough to provide a specified, substantial resistance to flow of additional hydraulic fluid into the fluid chambers 117*a*, 117*b*

The pressure regulation settings of hydraulic fluid for the extend action are independent from the pressure regulation settings of hydraulic fluid for the retract action of the damper actuator 102. Furthermore, the directional control of the pressure-regulated hydraulic fluid takes place for the extend action of damper actuator 102 through the flow-control extend direction port 135*b*, 135*d* before it enters gas over fluid pressure vessels 101*a*, 101*b*. This directional control is achieved by allowing the fluid to flow through the actuator extend one-way valves 112*b*, 112*d* only, and by blocking the flow path through the actuator retract one-way valves 112*a*, 112*c*, which only allow flow during the retract action of the damper actuator 102.

As the heave motion shifts from crest to trough, the damper actuator 102 starts to retract in similar proportion; therefore, the pistons 115*a*, 115*b* acting under gas pressure from gas chambers 116*a*, 116*b* will displace hydraulic fluid inside the hydraulic fluid chambers 117*a*, 117*b* of the gas over fluid pressure vessels 101*a*, 101*b* to flow from within the two vessels towards the damper actuator 102. The directional control of fluid takes place at the actuator extend one-way valves 112*b*, 112*d* which blocks the fluid, and also at actuator retract one-way valves 112*a*, 112*c* which allows the fluid flow to proceed to flow-control retract direction ports 135*a*, 135*c*. Downstream of the flow-control retract direction ports 135*a*, 135*c*, pressure regulation of hydraulic fluid takes place according to the setting of the flow-control retract throttle valves 113*a*, 113*c*. This regulation is controlled by the position of the flow-control retract throttle valves 113*a*, 113*c*, which can be adjusted, for example, depending on the characteristics of significant wave height (e.g., a certain value or a range of values of the significant wave height). In certain instances, the throttle valves 113*a*, 113*c* are multi-setting or continuously variable flow metering valves. The flow-control retract throttle valves 113*a*, 113*c* create a venturi effect on the flow of hydraulic fluid through the hydraulic manifold 103.

When the damper actuator 102 retracts, the rod 104 forces the piston 110 away from the hydraulic manifold 103, and the hydraulic fluid chamber 119 receives retreating fluid from hydraulic fluid chambers 117*a*, 117*b* displaced by pistons 115*a*, 115*b* due to gas pressure force from gas chambers 116*a*, 116*b*. In the hydraulic manifold 103, the hydraulic fluid flows through the actuator retract valves 112*a*, 112*c*, into the flow-control retract direction ports 135*a*, 135*c*, through an opening defined by the position of the flow-control retract throttle valves 113*a*, 113*c*, through the flow-control channels 133*a*, 133*b*, through the hydraulic porting 134, through the annular flow path 138, and into the damper actuator 102. The pressurized hydraulic fluid entering the hydraulic fluid chamber 119 of the damper actuator 102 forces the piston 110 away from the hydraulic manifold 103, which compresses the low pressure gas volume of the gas chamber 118. In some instances, the compression of nitrogen gas in the gas chamber 118 does not provide any gas spring effect to the functioning of the heave compensator unit 100.

The integrated flow control devices 111*a*, 111*b* within hydraulic manifold 103 can be used to adjust bi-directional hydraulic damping properties of the heave compensator unit 100. The integrated flow-control devices 111*a*, 111*b* include annular flow-control channels 133*a*, 133*b* for transporting fluid from or to the damper actuator 102 through the hydraulic porting 134 during extend or retract mode. The flow-control extend throttle valves 113*b*, 113*d* control the pressure drop of hydraulic fluid only in extend mode, and the flow-control retract throttle valves 113*a*, 113*c* control the pressure drop of hydraulic fluid only in retract mode. The actuator-retract valves 112*a*, 112*c* control the direction of fluid in retract mode (allowing fluid only to the flow-control retract throttle valves 113*a*, 113*c*), and the actuator-extend valves 112*b*, 112*d* control the direction of fluid in extend mode (allowing hydraulic fluid only to the flow-control extend valves 113*b*, 113*d*). The flow-control extend direction ports 135*b*, 135*d* transport fluid from the flow-control extend throttle valves 113*b*, 113*d* to the actuator-extend valves 112*b*, 112*d* in extend mode, and the flow-control retract direction ports 135*a*, 135*c* transport fluid from the actuator-retract valves 112*a*, 112*c* to the flow-control retract throttle valves 113*a*, 113*c* in retract mode.

The geometry of the hydraulic manifold 103 can be changed or reconfigured to incorporate one or more gas over fluid pressure vessels 101*a*, 101*b*, and one or more integrated flow-control devices 111*a*, 111*b* depending on the number of gas over fluid pressure vessels 101*a*, 101*b* used. The geometry of the hydraulic manifold 103 or the geometry of the integrated flow-control devices 111*a*, 111*b* can be changed or reconfigured to adjust the bi-directional hydraulic damping properties based on different significant wave heights or a range of significant wave heights. The integrated flow control device(s) 111*a*, 111*b* incorporated into the hydraulic manifold 103 can be operated or adjusted while the heave compensator unit 100 remains fully intact, for example, without having to dismantle or depressurize the compensator unit or any part of it thereof.

In the example shown, the integrated flow control devices 111*a*, 111*b* include throttle stems 136*a*, 136*b*, 136*d*, 136*d* that can be used to change the position of the respective flow control throttle valves 113*a*, 113*b*, 113*c*, 113*d*. The coverings 132*a*, 132*b* can be removed from the integrated flow control devices 111*a*, 111*b* to reveal the throttle stems 136*a*, 136*b*, 136*c*, 136*d*. The throttle stems 136*a*, 136*c* can be adjusted to increase or decrease the area of the flow available to the hydraulic fluid during the retract action, and throttle stems 136*b*, 136*d* can be adjusted to increase or decrease the area of flow available to the hydraulic fluid during extend action.

The heave compensator unit 100 shown in FIGS. 1A and 1B is an example of an in-line passive heave compensator system. The damper actuator is an example of a passive damper that extends and retracts in response to an external dynamic load (e.g., coupled to the hooks 105, 106). The gas over fluid pressure vessels 101*a*, 101*b* are examples of a fluid vessel that communicates hydraulic fluid with the damper actuator as the damper actuator extends and retracts in response to the external dynamic load. The gas over fluid pressure vessels 101*a*, 101*b* can be, for example, nitrogen over oil pressure vessels. The hydraulic manifold 103 is an example of a hydraulic manifold that communicates hydraulic fluid between the damper actuator and the fluid vessel. The flow-control extend throttle valves 113*b*, 113*d* are examples of an extension flow-metering device in an extension flow path between the damper actuator and the fluid vessel, wherein the extension flow path receives flow only during extension of the damper actuator. The flow-control retract throttle valves 113*a*, 113*c* are examples of a retraction flow-metering device in a retraction flow path between the damper actuator and the fluid vessel, wherein the retraction flow path receives flow only during retraction of the damper actuator. The flow-metering device can be, for example, an adjustable orifice, a needle valve, another type of valve which provides adjustable variable flow area etc.

The actuator-extend valves 112*b*, 112*d* are examples of an extension check valve that permits flow between the fluid vessel and the extension flow path during extension of the damper actuator, and that prevents flow between the fluid vessel and the extension flow path during retraction of the damper actuator. The actuator-retract valves 112*a*, 112*c* are examples of a refraction check valve that permits flow between the fluid vessel and the retraction flow path during retraction of the damper actuator, and that prevents flow between the fluid vessel and the retraction flow path during extension of the damper actuator.

The gas chambers 116*a*, 116*b* are examples of a gas spring that applies pressure to allow flow of the hydraulic fluid from the fluid vessel into the hydraulic manifold. In the example shown in FIG. 1B, the extension flow-metering devices (i.e., the flow-control extend throttle valves 113*b*, 113*d*) are changeable to be more or less restrictive to flow through the extension flow paths, and the retraction flow-metering devices (the flow-control retract throttle valves 113*a*, 113*c*) are changeable to be more or less restrictive to flow through the retraction flow paths. The throttle stems 136*b*, 136*d* are examples of extension flow adjusters that are moveable to change the extension flow-metering device, and the throttle stems 136*a*, 136*c* are examples of retraction flow adjusters that are moveable to change the retraction flow-metering device. The throttle stems can include, for example, a profiled end, a handle, a hex profile, a spool that moves back and forth, etc. The flow-control throttle valves 113*a*, 113*b*, 113*c*, 113*d* are independently changeable to independently modify an extension or refraction property of the damper.

In the example shown in FIG. 1B, the damper includes an elongate vessel, and a piston 110 disposed within the elongate vessel. The piston 110 is adapted to move with respect to the rod end of the elongate vessel to extend or retract the damper. The damper in FIG. 1B includes a rod 104 connected between the piston 110 and the external load. The rod 104 includes a first end toward the piston 110 inside the vessel, a body extending through the rod end of the elongate vessel, and a second end toward the external load outside the vessel.

In some aspects of operation, the extension flow-metering device (e.g., flow-control extend throttle valve 113*b* or 113*d*) changes to be more or less restrictive to flow through the extension flow path, and the retraction flow-metering device (e.g., flow-control retract throttle valves 113*a* or 113*c*) changes to be more or less restrictive to flow through the retraction flow path. The extension flow-metering device changes in response to movement of an extension flow adjuster (e.g., rotation of the throttle stem 136*b* or 136*d*), and the retraction flow-metering device changes in response to movement of a retraction flow adjuster (e.g., rotation of the throttle stem 136*a* or 136*c*). The extension flow adjuster and the retraction flow adjuster move in response to external actuators (e.g., a profile of an external docking station, a tool, etc.). The extension flow-metering device can be changed to be more or less restrictive to flow through the extension flow path independent of changing the retraction flow-metering device; and the retraction flow-metering device can be changed to be more or less restrictive to flow through the retraction flow path independent of changing the extension flow-metering device.

In another example aspect of operation, as the damper extends in response to a first external load (i.e., an external load in a direction that causes the damper to extend), flow of the hydraulic fluid is communicated between the damper and the fluid vessel by the extension flow-metering device in the extension flow path in the hydraulic manifold; while flow is prevented between the damper and the fluid vessel through the retraction flow path. In another example aspect of operation, as the damper retracts in response to a second, different external load (i.e., an external load in a direction that causes the damper to retract), flow of the hydraulic fluid is communicated between the damper and the fluid vessel by the retraction flow-metering device in the retraction flow path; while flow is prevented between the damper and the fluid vessel through the extension flow path. An extension check valve (e.g., actuator extend valve 112*b* or 112*d*) permits flow between the fluid vessel and the extension flow path during extension of the damper and prevents flow between the fluid vessel and the extension flow path during retraction of the damper. A retraction check valve (e.g., actuator retract valve 112*a* or 112*c*) permits flow between the fluid vessel and the retraction flow path during retraction of the damper and prevents flow between the fluid vessel and the refraction flow path during extension of the damper. The extension and retraction flow-metering devices are independently changeable to independently modify an extension or retraction property of the damper.

Figure 6:
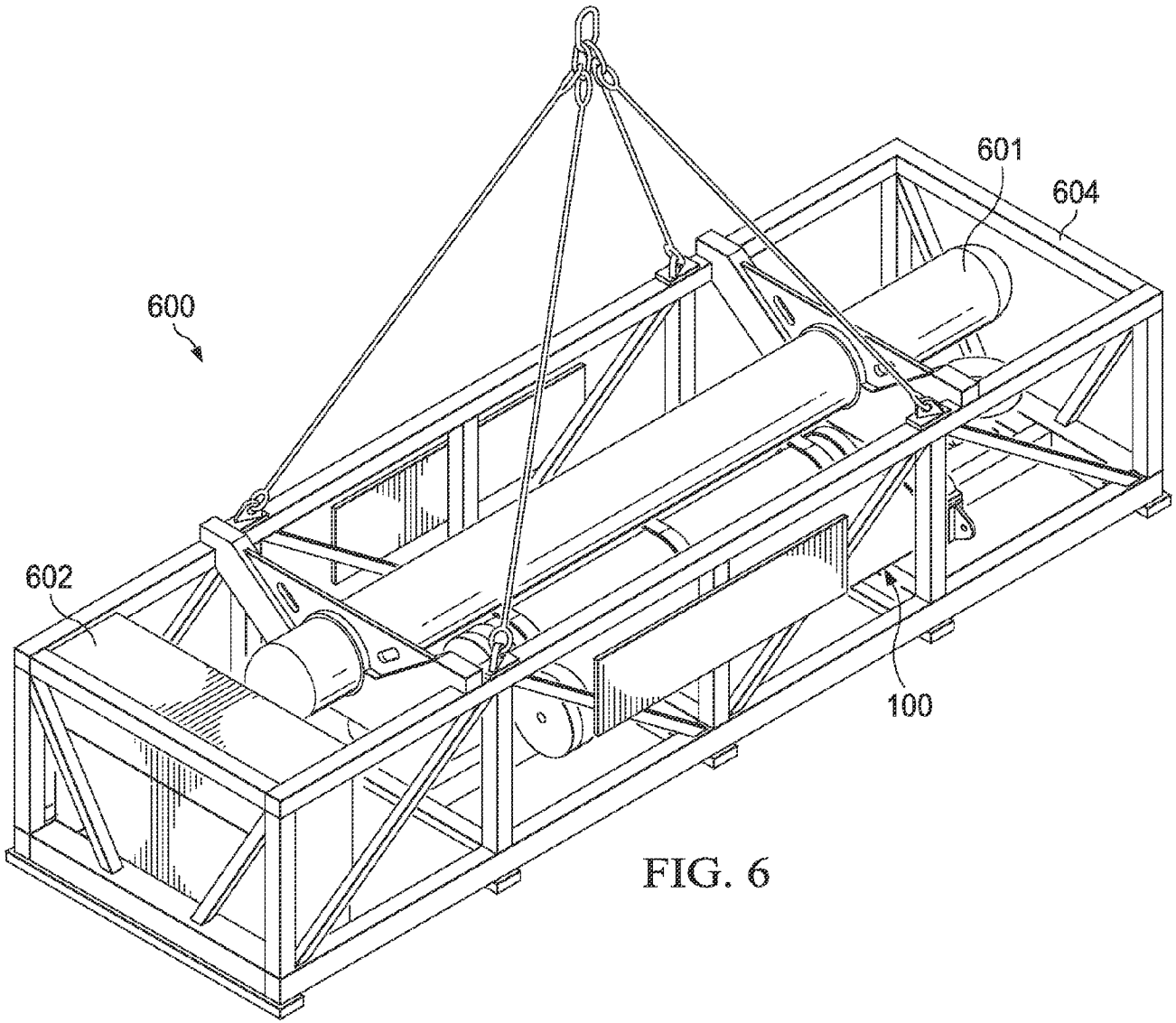
FIG. 6 is a perspective view of an example transport and docking station for tuning and transporting a heave compensator unit.

FIG. 6 is a perspective view of an example system 600 that includes the heave compensator unit 100. The system 600 includes a structural frame 604, a built-in functional docking station 602, a nitrogen storage tank 601, and other features. The structural frame 604 accommodates the heave compensator unit 100 to carry the unit and provide safe transport. The docking station 602 provides various functions to the heave compensator unit 100 when the heave compensator unit 100 is docked in the structural frame 604. The functions provided by the docking station 602 relate to the intended operations of the heave compensator unit 100. As described in more detail below, the docking station 602 includes a fluid circuit system in fluid communication between the supply system (e.g., the nitrogen storage tank 601, a hydraulic fluid supply tank, etc.) and the heave compensator unit 100; the fluid circuit system includes valves, controls, and other features adapted to adjust the nitrogen gas and hydraulic fluid levels in the heave compensator unit 100.

In some implementations, the system 600 combines and integrates into a single machine all of the functional requirements to transport, test, operate and safely store the heave compensator unit 100. This can be more efficient, faster, and reduce errors, for example, compared to the use of separate systems for the various functions. For example, greater operational efficiency can be achieved by reducing the number of hardware kits and working time for completing each function, and the chances of human related errors can be reduced by providing measurement readings related to the compensator unit at one location.

In some instances, the system 600 is a transport and docking station (TDS) for the heave compensator unit 100. A transport and docking station can include the following indirect (i.e., pilot) functional circuits: (1) reservoir fill circuit, (2) fluid circulation circuit, (3) low pressure pilot pneumatic circuit, (4) nitrogen tank fill circuit, and possibly others. Examples of these circuits are discussed below.

Reservoir Fill Circuit: The main function of this circuit is to fill the fluid reservoir with the necessary level of hydraulic fluid. An external oil source is connected to an interface port for this circuit via a reservoir fill assembly (RFA). A hydraulic pump (pneumatic operated, powered by the low-pressure pilot pneumatic circuit) draws fluid from an external resource and pumps into the hydraulic reservoir via a set of filters to ensure clean hydraulic supply in the hydraulic reservoir. The pump is turned on until the reservoir is filled at the desired level. The hydraulic level can be monitored at a sight level gauge installed at the reservoir.

Fluid Circulation Circuit: The main function of this circuit is to ensure proper filtration and achieve a desired fluid cleanliness level of the hydraulic oil that is to be used as a control volume within the heave compensator unit. Once the external source of hydraulic oil is transferred into the reservoir, the fluid suction port of the hydraulic pump (pneumatic operated, powered by low-pressure pilot pneumatic circuit) is switched from being connected to the external oil source to the hydraulic reservoir; this enables the hydraulic reservoir to become the hydraulic oil source for the hydraulic pump. As the pump is turned on, it draws hydraulic fluid from the reservoir through a suction line filter or a suction strainer and directs it to the reservoir via a set of hydraulic filters and back into the reservoir. This process is continued until fluid samples analyzed have the desired cleanliness level. During the cleanliness process, circulation differential pressure across filter elements can be monitored to evaluate the condition of the filter element, selection of a single filter or two filters can be made to speed up the cleanliness process. The circuit also has a provision to take fluid samples either immediately downstream of filters via bleed valves or at the hydraulic reservoir. Additionally, hydraulic circuit pressure can also be monitored.

Low-Pressure Pilot Pneumatic Circuit: The main function of this circuit is to provide low-pressure pilot pneumatic supply to the main hydraulic pumps as well as to the main nitrogen booster pump. This circuit is connected to the external low-pressure pilot pneumatic supply by an interface on the TDS. The circuit provides raw external air supply pressure, filtration, pressure regulation, lubrication to the external air supply, regulated pressure monitoring and supply directional control of pneumatic supply to other circuits within the TDS.

Nitrogen Tank Fill Circuit: The main function of this circuit is to charge the nitrogen tank with a specified pressure of nitrogen gas. An external source of nitrogen gas supply can be connected to the TDS via an interface port and set of valves, which are used to direct the nitrogen gas to the nitrogen tank. Additionally, a nitrogen booster pump (pneumatic operated, powered by low-pressure pilot pneumatic circuit) can also be utilized to boost the pressure of the external gas source to be directed into the nitrogen tank. Both idle and boosted gas pressures can be monitored.

A transport and docking station can include the following direct (i.e., main) functional circuits: (1) compensator hydraulic circuit, (2) compensator gas circuit, and possibly others. Examples of these circuits are discussed below.

Compensator Hydraulic Circuit: Preparing in-line passive heave compensator for offshore load deployment typically includes functional and pressure testing of the compensator prior to actual use of the compensator system. Additionally, preparing the compensator for offshore usage often requires adjusting the amount of hydraulic fluid inside the compensator for proper compensator stiffness setting in relation to the loads being deployed by it.

The main function of the compensator hydraulic circuit is to adjust or re-adjust liquid volume inside the compensator for a single load deployment or multiple load deployment during a single or multiple events. This circuit interfaces directly with a specially designed hydraulic manifold of an in-line passive heave compensator at two places. The circuit's major subsystems and components include hydraulic pumps (pneumatic operated, powered by the low-pressure pilot pneumatic circuit) both low pressure and high pressure, filtration system, volume measurement devices, pressure monitoring devices, charge line, discharge line, and pressure safety device(s).

The compensator hydraulic circuit can perform the following test functions for an in-line passive heave compensator: (1) perform a compensator retract stroke test at low pressure (this can be achieved after the compensator is extended using a different circuit); (2) monitoring of retract stroke pressure; (3) perform a compensator hydrostatic pressure test to ensure no leaks; (4) monitoring of hydrostatic pressure; (5) provide over-pressurization protection; and possibly others.

The compensator hydraulic circuit can also perform deployment-related functions for an in-line passive heave compensator. The compensator hydraulic circuit can fill the compensator unit with the proper level of hydraulic fluid, which is required to undertake a certain load handling or deployment operation. This can be performed by using TDS multiple pressure hydraulic pumps at either no gas pressure or at a full charge of gas pressure within the compensator unit. This operation is done via interfacing the TDS with the compensator unit via a specially designed hydraulic manifold. The fluid volume is measured using instrumentation. The compensator hydraulic circuit can completely drain the in-line compensator with hydraulic fluid either after initial load deployment or after multiple load deployment. Utilizing this function will prepare the compensator for storage. This is done by additionally utilizing low-pressure pilot pneumatic circuit. This circuit also provides over pressurization protection to the compensator unit.

Compensator Gas Circuit: Preparing in-line passive heave compensator for offshore load deployment typically includes functional and pressure testing of the compensator prior to actual use of the compensator system. Additionally, preparing the compensator for offshore usage typically requires correct gas charge pressure inside the compensator for proper compensator stiffness setting in relation to the loads being deployed by it.

The main function of the compensator gas circuit is to adjust or re-adjust gas charge inside the compensator for a single load deployment or multiple load deployment during a single or multiple events. This circuit interfaces directly with two nitrogen-over-gas vessels on the blind side of the compensator and with a hydraulic actuator on the blind side. The compensator gas circuit's major subsystems and components include nitrogen booster pump (pneumatic operated, powered by low-pressure pilot pneumatic circuit), nitrogen storage tank, pressure monitoring devices, charge and discharge lines (same lines can charge and discharge nitrogen gas), and pressure safety device(s).

The compensator gas circuit can perform the following test functions for an in-line passive heave compensator: (1) perform a compensator extend stroke test at low pressure; (2) monitoring of extend stroke pressure; (3) perform a compensator gas pressure test to ensure no leaks; (4) monitoring of gas pressure; (5) provide over-pressurization protection; and possibly others.

The compensator gas circuit can also perform deployment-related functions for an in-line passive heave compensator. The compensator gas circuit can charge the compensator unit with proper nitrogen gas pressure which is required to undertake a certain load handling or deployment operation. Depending on the gas charge pressure this can be performed by connecting the nitrogen gas tank to a specific compensator chamber, or if higher gas charge pressure is required, a nitrogen booster pump is utilized for the purpose. The charge pressure is measured using instrumentation. The compensator gas circuit can completely discharge the in-line compensator with nitrogen gas either after initial load deployment of after multiple load deployments. Utilizing this function will prepare the compensator for storage. This is done by additionally utilizing low-pressure pilot pneumatic circuit. This circuit also provides over pressurization protection to the compensator unit.

While this specification contains many details, these should not be construed as limitations on the scope of what may be claimed, but rather as descriptions of features specific to particular examples. Certain features that are described in this specification in the context of separate implementations can also be combined. Conversely, various features that are described in the context of a single implementation can also be implemented in multiple embodiments separately or in any suitable subcombination.

A number of embodiments have been described. Nevertheless, it will be understood that various modifications can be made. Accordingly, other embodiments are within the scope of the following claims.

What is claimed is:

1. An in-line passive heave compensator system comprising:

a damper actuator that extends and retracts by force applied by an external load;

a fluid vessel that communicates hydraulic fluid with the damper actuator as the damper actuator extends and retracts;

a hydraulic manifold that communicates the hydraulic fluid between the damper actuator and the fluid vessel, the hydraulic manifold comprising:

an extension flow-metering device in an extension flow path between the damper actuator and the fluid vessel, the extension flow path receives flow only during extension of the damper actuator;

a retraction flow-metering device in a retraction flow path between the damper actuator and the fluid vessel, the retraction flow path receives flow only during retraction of the damper actuator, an extension check valve that permits flow between the fluid vessel and the extension flow path during extension of the damper actuator and that prevents flow between the fluid vessel and the extension flow path during retraction of the damper actuator; and a retraction check valve that permits flow between the fluid vessel and the retraction flow path during retraction of the damper actuator and that prevents flow between the fluid vessel and the retraction flow path during extension of the damper actuator.

2. The system of claim 1, wherein the fluid vessel comprises a spring that urges flow of the hydraulic fluid from the fluid vessel into the hydraulic manifold.

3. The system of claim 1, wherein the extension flow-metering device is adjustable to be more or less restrictive to flow through the extension flow path, the retraction flow-metering device is adjustable to be more or less restrictive to flow through the retraction flow path, and the hydraulic manifold comprises:

an extension flow adjuster that is moveable to adjust the extension flow-metering device; and a retraction flow adjuster that is moveable to adjust the retraction flow-metering device.

4. The system of claim 1, wherein the damper actuator comprises:

an elongate vessel;

a piston disposed within the elongate vessel and adapted to move with respect to a first end of the elongate vessel as the damper actuator extends or retracts; and a rod connected between the piston and the external load, the rod comprising a first end toward the piston, a body extending through a first end of the elongate vessel, and a second end toward the external load.

5. The system of claim 1, wherein the extension flow-metering device and the retraction flow-metering device are independently adjustable to independently modify an extension or retraction property of the damper actuator.

6. The system of claim 1, further comprising a transport frame adapted to receive for transport a heave compensator unit comprising the damper actuator, the fluid vessel, and the hydraulic manifold.

7. The system of claim 6, wherein the transport frame houses a docking station for the heave compensator unit, the docking station comprising:

a supply system comprising a gas supply outlet and a hydraulic fluid supply outlet; and a fluid circuit system in fluid communication between the supply system and the heave compensator unit, the fluid circuit system adapted to adjust gas and hydraulic fluid levels in the fluid vessel and the damper actuator.

8. The system of claim 1, wherein:

the fluid vessel comprises a first fluid vessel, and the system further comprises a second fluid vessel that communicates hydraulic fluid with the damper actuator as the damper actuator extends and retracts;

the hydraulic manifold communicates the hydraulic fluid between the damper actuator and the first and second fluid vessels, and the hydraulic manifold comprises:

a first extension flow-metering device in a first extension flow path between the damper actuator and the first fluid vessel, the first extension flow path receives flow only during extension of the damper actuator;

a first retraction flow-metering device in a first retraction flow path between the damper actuator and the first fluid vessel, the first retraction flow path receives flow only during retraction of the damper actuator;

a second extension flow-metering device in a second extension flow path between the damper actuator and the second fluid vessel, the second extension flow path receives flow only during extension of the damper actuator; and a second retraction flow-metering device in a second retraction flow path between the damper actuator and the second fluid vessel, the second retraction flow path receives flow only during retraction of the damper actuator.

9. A method of communicating hydraulic fluid in a hydraulic manifold between a damper actuator and a fluid vessel of an in-line passive heave compensator system, the damper actuator being adapted to passively extend and retract in response to an external load, the method comprising:

as the damper actuator extends in response to a first external load:

communicating flow of the hydraulic fluid between the damper actuator and the fluid vessel through an extension flow path that includes an extension flow-metering device in the hydraulic manifold, and preventing flow between the damper actuator and the fluid vessel through a retraction flow path that includes a retraction flow-metering device in the hydraulic manifold, wherein an extension check valve of the hydraulic manifold permits flow between the fluid vessel and the extension flow path during extension of the damper actuator and prevents flow between the fluid vessel and the extension flow path during retraction of the damper actuator; and as the damper actuator retracts in response to a second, different external load:

communicating flow of the hydraulic fluid between the damper actuator and the fluid vessel through the retraction flow path; and preventing flow between the damper actuator and the fluid vessel through the extension flow path, wherein a retraction check valve of the hydraulic manifold permits flow between the fluid vessel and the retraction flow path during retraction of the damper actuator and prevents flow between the fluid vessel and the retraction flow path during extension of the damper actuator.

10. The method of claim 9, wherein a position of the extension flow-metering device influences a rate of extension of the damper actuator, and a position of the retraction flow-metering device influences a rate of retraction of the damper actuator.

11. The method of claim 9, wherein the extension flow-metering device and the retraction flow-metering device are independently adjustable to independently modify an extension or retraction property of the damper actuator.

12. A method of adjusting damping properties of an in-line passive heave compensator system comprising a damper actuator and a fluid vessel, the damper actuator being adapted to passively extend and retract in response to an external load, the fluid vessel being adapted to communicate hydraulic fluid with the damper actuator as the damper actuator extends and retracts, the method comprising:

in a hydraulic manifold comprising an extension flow path and a retraction flow path each adapted to communicate hydraulic fluid between the damper actuator and the fluid vessel:

adjusting an extension flow-metering device to be more or less restrictive to flow through the extension flow path, an extension check valve of the hydraulic manifold permitting the extension flow path to receive flow only during extension of the damper actuator, and adjusting a retraction flow-metering device to be more or less restrictive to flow through the retraction flow path, a retraction check valve of the hydraulic manifold permitting the retraction flow path to receive flow only during retraction of the damper actuator.

13. The method of claim 12, comprising:

adjusting the extension flow-metering device in response to movement of an extension flow adjuster of the hydraulic manifold; and adjusting the retraction flow-metering device in response to movement of a retraction flow adjuster of the hydraulic manifold.

14. The method of claim 13, wherein the extension flow adjuster and the retraction flow adjuster move in response to actuators of an external docking station.

15. The method of claim 12, comprising adjusting the extension flow-metering device to be more or less restrictive to flow through the extension flow path independent of adjusting the retraction flow-metering device.

16. The method of claim 12, comprising adjusting the retraction flow-metering device to be more or less restrictive to flow through the retraction flow path independent of adjusting the extension flow-metering device.

* * * * *